US011590566B2

(12) United States Patent
Bilski

(10) Patent No.: US 11,590,566 B2
(45) Date of Patent: Feb. 28, 2023

(54) ROLLER STAND HAVING RETAINING DEVICES FOR FASTENING INTERMEDIATE-AREA SPRAY BARS

(71) Applicant: Primetals Technologies Austria GmbH, Linz (AT)

(72) Inventor: Lukasz Bilski, Leonding (AT)

(73) Assignee: Primetals Technologies Austria GmbH, Linz (AT)

( * ) Notice: Subject to any disclaimer, the term of this patent is extended or adjusted under 35 U.S.C. 154(b) by 0 days.

(21) Appl. No.: 17/274,707

(22) PCT Filed: Sep. 18, 2019

(86) PCT No.: PCT/EP2019/074955
§ 371 (c)(1),
(2) Date: Mar. 9, 2021

(87) PCT Pub. No.: WO2020/064451
PCT Pub. Date: Apr. 2, 2020

(65) Prior Publication Data

US 2021/0323051 A1 Oct. 21, 2021

(30) Foreign Application Priority Data

Sep. 25, 2018 (AT) ..... A 50823/2018

(51) Int. Cl.
*B22D 11/128* (2006.01)
*B22D 11/124* (2006.01)

(52) U.S. Cl.
CPC ..... *B22D 11/1285* (2013.01); *B22D 11/1246* (2013.01); *B22D 11/1282* (2013.01)

(58) Field of Classification Search
CPC ..... B22D 11/12; B22D 11/124; B22D 11/128; B22D 11/1282; B22D 11/1285; B22D 11/1288; B22D 11/1243; B22D 11/1246
(Continued)

(56) References Cited

U.S. PATENT DOCUMENTS 2,789,328 A * 4/1957 Ackerman et al. .... B22D 11/14 164/444
3,381,743 A * 5/1968 Bode, Jr. ..... B22D 11/053 164/416
(Continued)

FOREIGN PATENT DOCUMENTS

CN 202155497 U 3/2012
CN 202910270 U 5/2013
(Continued)

OTHER PUBLICATIONS

International Search Report and Written Opinion received in International Application No. PCT/EP2019/074955 dated Nov. 13, 2019, pp. 14.
(Continued)

*Primary Examiner* — Kevin P Kerns
(74) *Attorney, Agent, or Firm* — Liang & Hennessey LLP; Brian Hennessey

(57) ABSTRACT

A roller stand for a billet guide of a continuous billet casting machine, having a carrying frame for mounting at least one lower supporting roller, wherein the roller stand includes retaining devices for fastening intermediate-area spray bars. A billet guide and a continuous billet casting machine having such a roller stand.

11 Claims, 3 Drawing Sheets

(58) Field of Classification Search
USPC ..... 164/442, 448
See application file for complete search history.

(56) References Cited

U.S. PATENT DOCUMENTS

| | | | |
|---|---|---|---|
| 4,476,914 | A | 10/1984 | Wrossok |
| 2004/0020632 | A1 | 2/2004 | Zajber et al. |
| 2021/0323051 | A1 | 10/2021 | Bilski |

FOREIGN PATENT DOCUMENTS

| | | | | |
|---|---|---|---|---|
| CN | 203470863 | U | 3/2014 | |
| CN | 205128876 | U | 4/2016 | |
| CN | 206185109 | U | 5/2017 | |
| CN | 211803730 | U | 10/2020 | |
| DE | 2939321 | A1 | 4/1981 | |
| DE | 3039443 | A1 | 5/1982 | |
| EP | 0267303 | A1 | 5/1988 | |
| JP | S4937328 | A | 4/1974 | |
| JP | S4937328 | B1 | 10/1974 | |
| JP | S53149144 | A | 12/1978 | |
| JP | S5566054 | U | 5/1980 | |
| JP | S5656768 | A | 5/1981 | |
| JP | S5893444 | A | 6/1983 | |
| JP | S6340294 | Y2 | 10/1988 | |
| SU | 1320008 | A1 * | 6/1987 | ..... B22D 11/124 |
| WO | 02060619 | A1 | 8/2002 | |
| WO | 2007121804 | A1 | 11/2007 | |
| WO | 2009141244 | A1 | 11/2009 | |

OTHER PUBLICATIONS

Office Action received in Austrian Application No. A50823/2018 dated Apr. 4, 2019, pp. 3.

Office Action received in Austrian Application No. A50823/2018 dated May 19, 2020, pp. 2.

Japanese Office Action received in Japanese Application No. 2021-540910 dated Jun. 14, 2022, pp. 14.

Chinese Office Action received in Chinese Application No. 201910911390.0 dated Apr. 22, 2022, pp. 16.

* cited by examiner

ROLLER STAND HAVING RETAINING DEVICES FOR FASTENING INTERMEDIATE-AREA SPRAY BARS

CROSS-REFERENCE TO RELATED APPLICATIONS

The present application is a national phase application of PCT Application No. PCT/EP2019/074955, filed Sep. 18, 2019, entitled "ROLLER STAND HAVING RETAINING DEVICES FOR FASTENING INTERMEDIATE-AREA SPRAY BARS", which claims the benefit of Austrian Patent Application No. A50823/2018, filed Sep. 25, 2018, each of which is incorporated by reference in its entirety.

BACKGROUND OF THE INVENTION

1. Field of the Invention

The invention relates to a roller stand for a strand guide of a continuous billet casting machine, having a carrier frame for mounting at least one lower supporting roller, a strand guide and a continuous billet casting machine having a roller stand of this kind.

2. Description of the Related Art

In continuous billet casting machines, a metal strand, for example a steel strand, is guided in a strand guide in an arc from the mold via the secondary cooling chamber and the withdrawal straightening unit (WSU) to the runout area or roller table. Supporting and strand-guiding rollers mounted in roller stands in carrier frames support and guide it in the process, practically forming a strand guide channel. In the context of this application, the supporting and strand guiding rollers are referred to below simply by the term supporting roller for the sake of greater clarity.

Irregularities in the cooling of the metal strand can lead to the billet not having the desired shape. Instead of a desired rectangular cross section, for example, a rhombic cross section may be formed.

Irregular cooling will occur, for example, if the steel strand is not positioned centrally and symmetrically with respect to the centerline of the strand guide or the centerline of the strand guide channel. In that case, the distances between cooling nozzles applying cooling liquid and the steel strand will differ on different sides of the steel strand. Associated differences in cooling intensity may lead to a shape defect due to distortion of the steel strand.

However, even if a metal strand is positioned centrally and symmetrically with respect to the centerline of the strand guide—that is to say with respect to the centerline of the strand guide channel—irregular cooling may occur if the spray bars with the cooling nozzles are not arranged symmetrically with respect to the centerline of the strand guide—that is to say with respect to the centerline of the strand guide channel. However, precise alignment is associated with a large amount of effort and is prone to errors.

The roller stands of the strand guide must also be aligned precisely relative to one another.

SUMMARY OF THE INVENTION

The intention is to provide an apparatus by means of which it is possible in continuous billet casting machines to reduce the risk of asymmetric arrangement, the effort, and the susceptibility to errors in symmetrical arrangement, of spray bars and/or cooling nozzles.

This object is achieved by a roller stand for a strand guide of a continuous billet casting machine, having a carrier frame for mounting at least one lower supporting roller, characterized in that the roller stand comprises retaining devices for fastening spray bars.

The continuous billet casting machine is preferentially suitable for the continuous casting of a steel strand.

The metal strand is guided by the strand guide in an arc from the mold through the secondary cooling chamber to the WSU and to the runout area or roller table. Supporting and strand-guiding rollers mounted in roller stands in carrier frames support and guide the metal strand in the process, practically forming a strand guide channel.

In respect of a metal strand, "above" refers in the context of this application to the inner arc of the metal strand, while "below" refers to the outer arc of the metal strand. The inner arc of the metal strand has a smaller radius than the outer arc of the metal strand. The lower supporting roller serves to guide and support the outer arc of the metal strand. The metal strand has a start on the mold side and an end on the roller table side.

In continuous billet casting machines, the metal strands are generally supported in such a way in roller stands by means of supporting rollers in the region of the secondary cooling chamber that the areas between adjacent roller stands, in which there is no support, are many times longer than the respective length of the metal strand passing through a roller stand. These areas between adjacent roller stands—and also the area between the beginning of the secondary cooling chamber and the first roller stand as seen in the direction of the WSU from the mold, and also the area between the end of the secondary cooling chamber and the last roller stand as seen in the direction of the WSU from the mold—are referred to as intermediate areas in the context of this application.

Since a large proportion of the length of the metal strand to be cooled is located in the intermediate areas, it is particularly important to ensure uniform cooling in the intermediate areas.

Spray bars comprise cooling nozzles, from which spray cooling liquid—e.g. cooling water—supplied via the spray bars is sprayed onto the metal strand. In general, there is at least one spray bar for each side that is cooled. In the case of a continuous billet casting machine, for example, there will generally be at least four spray bars, for cooling from above, from below and from the two sides of the continuous billet.

Intermediate-area spray bars are spray bars which allow cooling of the metal strand in the intermediate areas—i.e. the areas of the strand guide of a secondary cooling chamber where the metal strand does not pass through any roller stands. These are not spray bars which merely allow cooling in a roller stand between and/or adjacent to supporting rollers of the roller stand.

According to the invention, there are, on the roller stands of a strand guide, retaining devices for fastening intermediate-area spray bars. The roller stands are aligned precisely relative to one another and define the strand guide channel. When the intermediate-area spray bars are fastened on the roller stands, which are themselves already precisely aligned relative to one another, the cooling nozzles are aligned symmetrically with respect to the centerline of the strand guide channel. Thus, the risk of asymmetric arrangement, effort and susceptibility to errors as regards symmetric arrangement of the intermediate-area spray bars and/or cooling nozzles is thereby reduced in the intermediate areas in comparison with a conventional construction, in which the roller stands and intermediate-area spray bars with cooling nozzles are aligned independently of one another.

When intermediate-area spray bars are fastened on roller stands, cooling in the area of the roller stand can also be easily accomplished in close proximity to the roller stand—allowing more uniform cooling than in conventional designs, where intermediate-area spray bars are not positioned as close to roller stands.

The roller stand also preferably comprises at least one conduit suitable for introducing spray cooling liquid into intermediate-area spray bars. Introduction can be direct or indirect—e.g. via a hose between the conduit and the intermediate-area spray bar. This allows a more compact and simpler construction of a continuous billet casting machine.

The conduit for introducing spray cooling liquid into the intermediate-area spray bars is preferably integrated in the carrier frame. This allows a more compact and simpler construction of a continuous billet casting machine. It is then possible, for example, for the carrier frame to be used as a carrier for the supporting roller and, at the same time, as a spray cooling liquid distributor for the intermediate-area spray bars. For example, the carrier frame can consist of hollow components that convey the spray cooling liquid in the cavities from feed points to connection points for the intermediate-area spray bars.

According to another embodiment, a conduit rack comprising the conduit for introducing spray cooling liquid into the intermediate-area spray bars is fastened on the carrier frame. The conduit rack preferably likewise comprises retaining devices for fastening intermediate-area spray bars.

The present application furthermore relates to a strand guide of a secondary cooling chamber for a continuous billet casting machine, characterized in that it comprises at least one roller stand according to the invention.

The present application furthermore relates to a continuous billet casting machine, characterized in that it comprises a strand guide according to the invention of a secondary cooling chamber having intermediate-area spray bars fastened on roller stands according to the invention.

Existing roller stands can simply be replaced by roller stands according to the invention, thus enabling the potential for savings according to the invention to be achieved easily not only in new-build plants but also in the case of modernizations.

BRIEF DESCRIPTION OF THE DRAWINGS

The invention is explained by means of schematic exemplary illustrations of embodiments.

DETAILED DESCRIPTION

Figure 1:
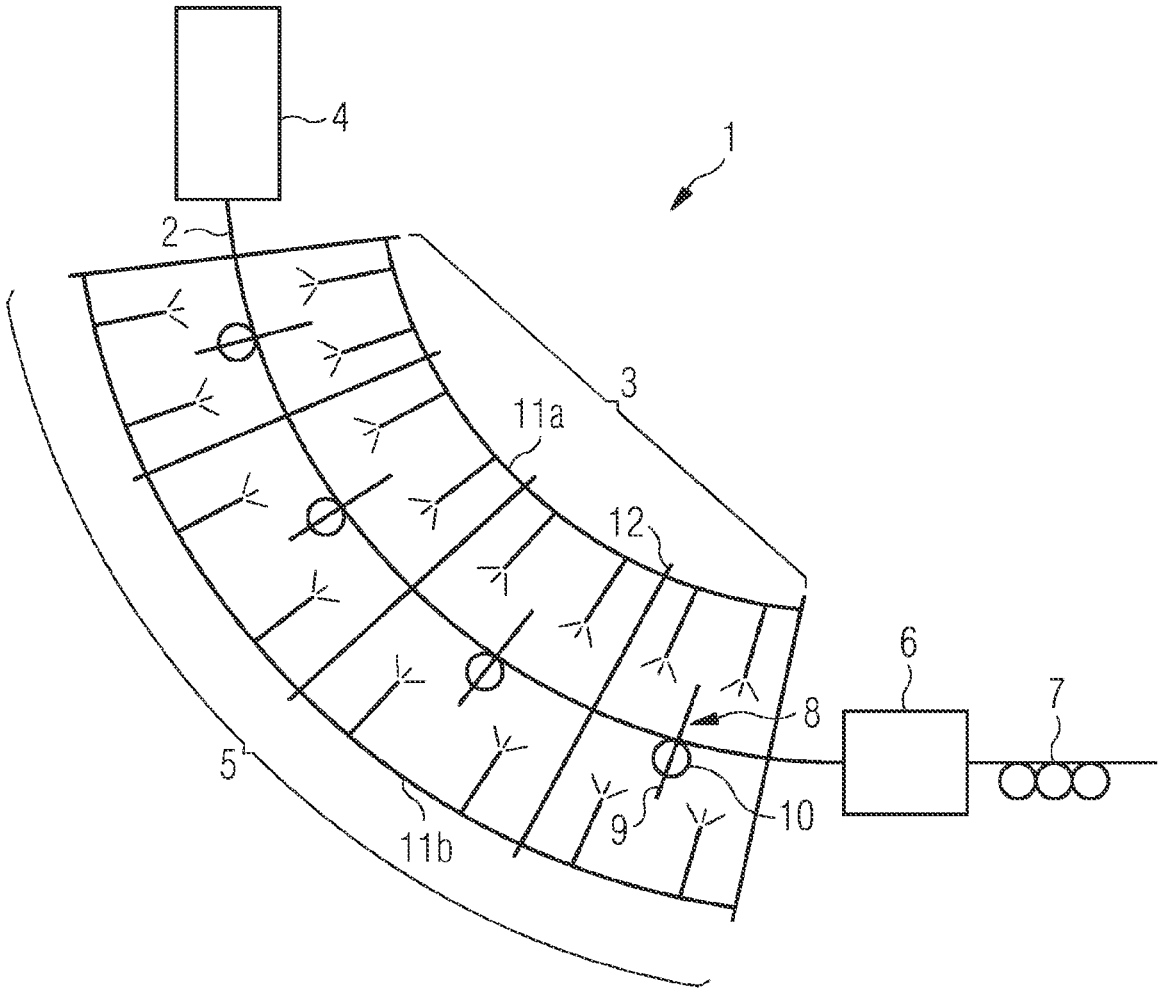
FIG. 1 shows schematically the general diagram of a conventional continuous billet casting machine with curved guidance and a secondary cooling chamber.

FIG. 1 shows schematically in oblique view how in a continuous billet casting machine 1 a metal strand 2, for example a steel strand, is guided in a strand guide 3 in an arc from the mold 4 via secondary cooling chamber 5 and WSU 6 to the roller table 7. Supporting rollers 10 mounted in roller stands 8 in carrier frames 9 support and guide it in the process, practically forming a strand guide channel. Cooling bars 11*a* and 11*b* are illustrated on racks 12 above and below the metal strand; schematically illustrated are intermediate-area spray bars, which allow cooling of the metal strand in the intermediate areas, i.e. the areas of the strand guide of a secondary cooling chamber where the metal strand does not pass through any roller stands. The spraying of spray cooling liquid from cooling nozzles to cool the metal strand is illustrated schematically. Cooling bars and cooling nozzles arranged next to the metal strand on the right- and left-hand sides along the metal strand as seen from the mold to the roller table are not illustrated for the sake of greater clarity.

Figure 2:
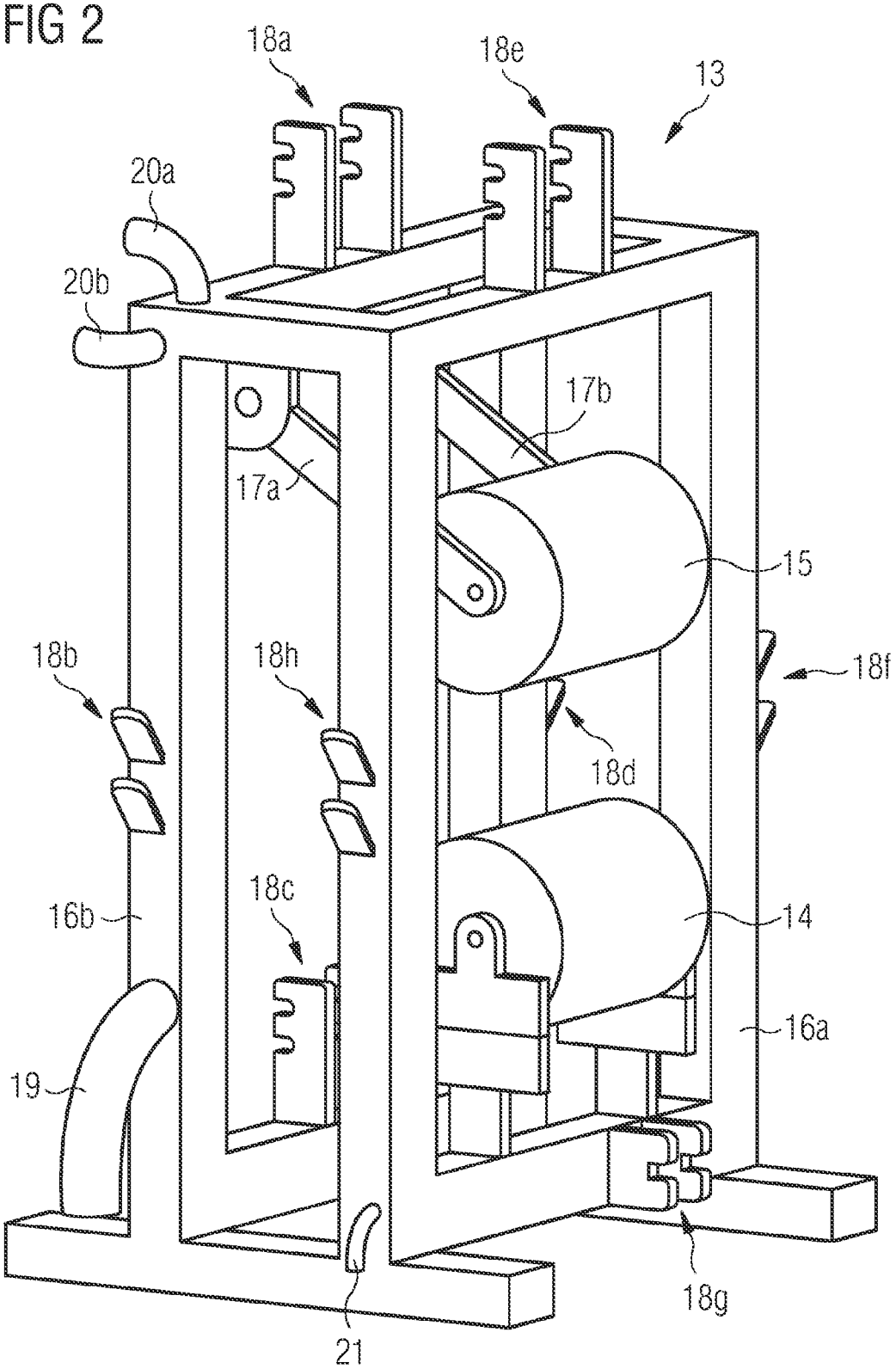
FIG. 2 shows a roller stand according to the invention.

FIG. 2 shows a roller stand 13 according to the invention for a strand guide of a continuous billet casting machine, having a carrier frame for mounting a lower supporting roller 14 and an upper supporting roller 15. The lower supporting roller 14 is mounted on carrier frame part 16*a*, and rockers 17*a*, 17*b* carrying the upper supporting roller 15 are mounted on carrier frame part 16*b*. A plurality of retaining devices 18*a*, 18*b*, 18*c*, 18*d*, 18*e*, 18*f*, 18*g*, 18*h* for fastening intermediate-area spray bars is provided on both carrier frame part 16*a* and carrier frame part 16*b*. The roller stand also comprises a conduit suitable for introducing spray cooling liquid into intermediate-area spray bars; this conduit is integrated in carrier frame part 16*b*. A feed point 19 and two connection points 20*a*, 20*b* for indirect connection of intermediate-area spray bars via hoses can be seen; the spray cooling liquid flows to the connection points through a cavity in carrier frame part 16*b*. Carrier frame part 16*a* can be supplied with cooling liquid for cooling carrier frame part 16*a* via the cooling liquid connection 21.

Figure 3:
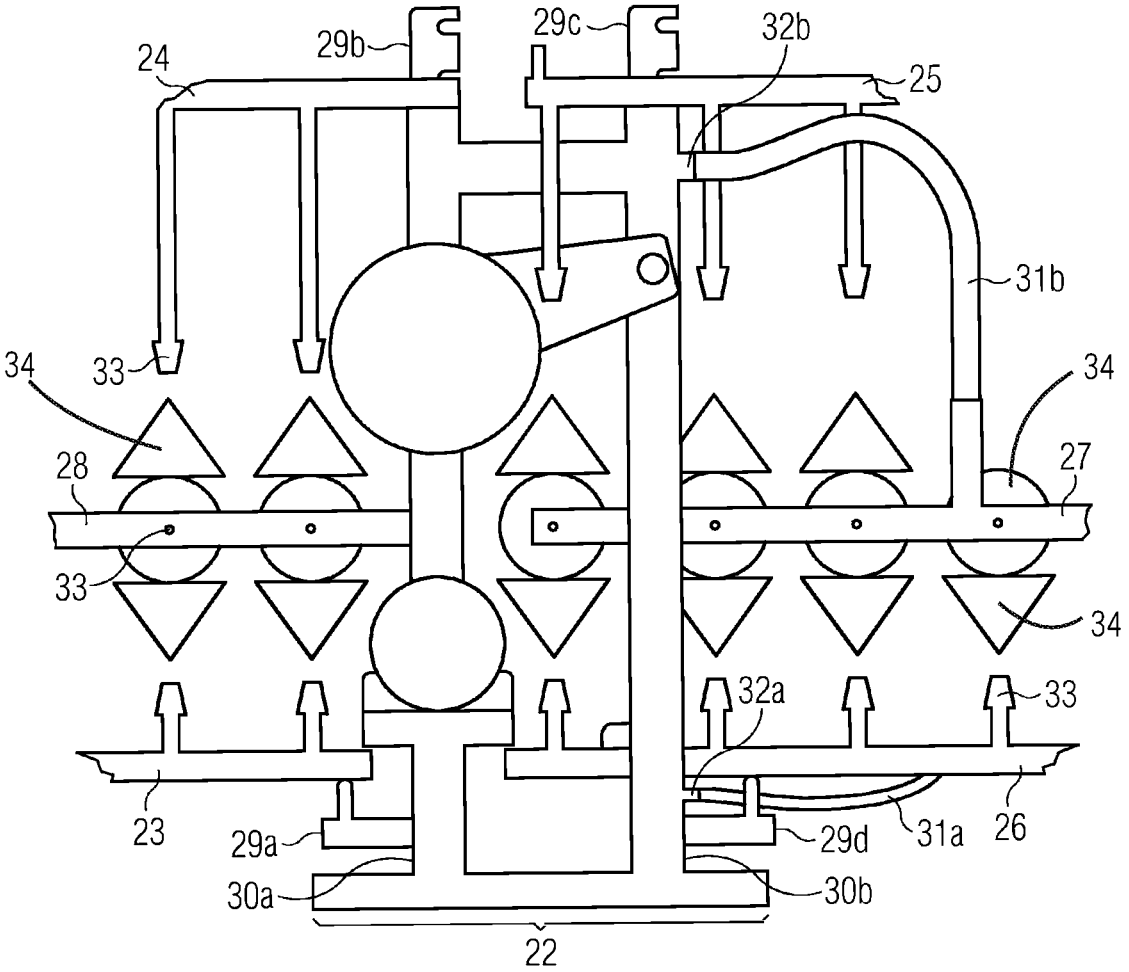
FIG. 3 shows a detail of a secondary cooling chamber having a roller stand according to the invention.

FIG. 3 shows a detail of a secondary cooling chamber having a roller stand 22 according to FIG. 2. Intermediate-area spray bars 23,24,25,26,27,28 are fastened on the roller stand 22 according to the invention, for example on the retaining devices 29*a*,29*b*,29*c*,29*d* visible in FIG. 3 on the carrier frame parts 30*a* and 30*b*. Other retaining devices that are present are not visible in FIG. 3. The figure illustrates how spray cooling liquid is conveyed to the intermediate-area spray bars 26 and 27 from connection points 32*a*, 32*b* via hoses 31*a*, 31*b*.

Cones 34 are used to indicate how spray cooling liquid is sprayed from spray nozzles 33 positioned symmetrically with respect to the center of the strand guide, i.e. with respect to the centerline of the strand guide channel. Spray nozzles 33 positioned on intermediate spray bars 27 and 28 are viewed from behind and therefore are represented as small circles, and cones 34 of spray cooling liquid emanating from these spray nozzles 33 are illustrated as large circles. Since the intermediate-area spray bars are fastened on the carrier frame and also extend into the space between the two carrier frame parts 30*a* and 30*b*, it is also possible according to the advantageous embodiment illustrated to cool between the carrier frame parts 30*a* and 30*b* in the region of the roller stand.

Although the invention has been illustrated and described more specifically in detail by means of the preferred illustrative embodiments, the invention is not restricted by the examples disclosed, and other variations can be derived therefrom by a person skilled in the art without exceeding the scope of protection of the invention.

LIST OF REFERENCE SIGNS

1 continuous billet casting machine
2 metal strand
3 strand guide
4 mold

5 secondary cooling chamber
6 WSU
7 roller table
8 roller stand
9 carrier frame
10 supporting rollers
11*a*, 11*b* cooling bars
12 racks
13 roller stand
14 lower supporting roller
15 upper supporting roller
16*a*, 16*b* carrier frame part
17*a*, 17*b* rockers
18*a*, 18*b*, 18*c*, 18*d*, 18*e*, 18*f*, 18*g*, 18*h* retaining device
19 feed point
20*a*, 20*b* connection point
21 cooling liquid connection
22 roller stand
23 intermediate-area spray bar
24 intermediate-area spray bar
25 intermediate-area spray bar
26 intermediate-area spray bar
27 intermediate-area spray bar
28 intermediate-area spray bar
29*a*, 29*b*, 29*c*, 29*d* retaining device
30*a*, 30*b* carrier frame part
31*a*, 31*b* hose
32*a*, 32*b* connection point
33 spray nozzle

The invention claimed is:

1. A roller stand for a strand guide of a continuous billet casting machine, comprising:

a carrier frame for mounting at least one lower supporting roller; and at least one conduit configured to introduce spray cooling liquid into intermediate-area spray bars;

wherein the roller stand comprises retaining devices configured to fasten intermediate-area spray bars; and wherein the at least one conduit configured to introduce spray cooling liquid into the intermediate-area spray bars is integrated in the carrier frame.

2. The roller stand as claimed in claim 1, wherein a conduit rack comprising the at least one conduit configured to introduce spray cooling liquid into the intermediate-area spray bars is fastened on the carrier frame.

3. The roller stand as claimed in claim 2, wherein the conduit rack comprises further retaining devices for fastening the intermediate-area spray bars.

4. The roller stand as claimed in claim 1, further comprising a hose coupling the at least one conduit and the intermediate-area spray bars and configured to introduce the spray cooling liquid into the intermediate-area spray bars.

5. The roller stand as claimed in claim 1, wherein:

the carrier frame comprises two carrier frame parts; and an upper supporting roller is mounted on the carrier frame by at least one rocker.

6. The roller stand as claimed in claim 5, wherein the two carrier frame parts are arranged to face each other and extend in a direction perpendicular to an extending direction of the strand guide.

7. The roller stand as claimed in claim 5, wherein:

the at least one rocker comprises two rockers;

the lower supporting roller is mounted on one of the carrier frame parts; and the upper supporting roller is mounted on the other of the carrier frame parts by the two rockers.

8. A strand guide of a secondary cooling chamber for a continuous billet casting machine, comprising at least one roller stand as claimed in claim 1.

9. A continuous billet casting machine, comprising the strand guide of the secondary cooling chamber as claimed in claim 8.

10. A roller stand for a strand guide of a continuous billet casting machine, comprising:

a carrier frame for mounting at least one lower supporting roller; and at least one conduit configured to introduce spray cooling liquid into intermediate-area spray bars;

wherein the roller stand comprises retaining devices configured to fasten intermediate-area spray bars;

wherein the at least one conduit configured to introduce spray cooling liquid into the intermediate-area spray bars is integrated in the carrier frame; and wherein the carrier frame comprises hollow components configured to convey the spray cooling liquid to connection points for the intermediate-area spray bars.

11. A roller stand for a strand guide of a continuous billet casting machine, comprising:

a carrier frame for mounting at least one lower supporting roller; and at least one conduit configured to introduce spray cooling liquid into intermediate-area spray bars;

wherein the roller stand comprises retaining devices configured to fasten intermediate-area spray bars;

wherein the at least one conduit configured to introduce spray cooling liquid into the intermediate-area spray bars is integrated in the carrier frame; and wherein the retaining devices for fastening the intermediate-area spray bars are provided on the carrier frame.

* * * * *